US010252308B2

(12) United States Patent
Hummert

(10) Patent No.: US 10,252,308 B2
(45) Date of Patent: Apr. 9, 2019

(54) PAINTLESS DENT REMOVAL TOOL

(71) Applicant: Richard Hummert, High Ridge, MO (US)

(72) Inventor: Richard Hummert, High Ridge, MO (US)

(73) Assignee: Richard Hummert, Fenton, MO (US)

( * ) Notice: Subject to any disclaimer, the term of this patent is extended or adjusted under 35 U.S.C. 154(b) by 240 days.

(21) Appl. No.: 14/932,211

(22) Filed: Nov. 4, 2015

(65) Prior Publication Data

US 2017/0120316 A1 May 4, 2017

(51) Int. Cl.
*B21D 1/06* (2006.01)
*B21D 1/12* (2006.01)

(52) U.S. Cl.
CPC ..... *B21D 1/06* (2013.01); *B21D 1/12* (2013.01)

(58) Field of Classification Search
CPC ... B21D 1/06; B21D 1/08; B21D 1/10; B21D 1/12; B21D 3/14; B21D 1/00
See application file for complete search history.

(56) References Cited

U.S. PATENT DOCUMENTS 1,754,994 A * 4/1930 Ferguson ..... B21D 1/06 72/479
2,485,486 A * 10/1949 Ferguson ..... B21D 1/06 72/479
2,485,487 A * 10/1949 Ferguson ..... B21D 1/06 72/479
2,485,488 A * 10/1949 Ferguson ..... B21D 1/06 72/479
2,485,489 A * 10/1949 Ferguson ..... B21D 1/06 72/479
2,485,490 A * 10/1949 Ferguson ..... B21D 1/06 72/479
2,844,060 A * 7/1958 Hagerty ..... B21D 1/06 72/479
2,900,853 A * 8/1959 Steck ..... B21D 1/06 72/457
3,100,336 A * 8/1963 Fannin ..... B21D 1/06 29/402.19
4,040,287 A * 8/1977 Wivinis ..... B21D 1/06 72/479
4,503,701 A * 3/1985 Hardy ..... B21D 1/06 72/325
5,461,900 A * 10/1995 Gutierrez ..... B21D 1/06 72/479
5,619,876 A * 4/1997 Choi ..... B21D 1/06 72/37
7,726,713 B2 * 6/2010 Oleksia ..... B25F 1/00 254/131
2005/0252271 A1 * 11/2005 Fredenberg ..... B21D 1/06 72/457

* cited by examiner

*Primary Examiner* — Edward Tolan
(74) *Attorney, Agent, or Firm* — Sandberg Phoenix & von Gontard, P.C.

(57) ABSTRACT

A paintless dent removal tool having a handle with a side and two opposing ends. The tool having a substantially rigid stem with a proximal segment and a distal segment opposite the proximal segment, and configured with the proximal segment extending from the side of the handle between the two opposing ends. The stem comprises an elongated curve between the proximal segment and the distal segment of the stem, and a substantially rigid tip extends in an angular fashion from the distal segment of the stem.

23 Claims, 6 Drawing Sheets

PAINTLESS DENT REMOVAL TOOL

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to an apparatus to facilitate the paintless removal of dents in the bodies of vehicles, and more particularly to a novel paintless dent removal ("PDR") hand tool having a unique configuration that improves access to hard-to-reach areas of the vehicle body and minimizes damage to the vehicle's access ports during the dent removal operation.

In the PDR industry, the repair shop relies upon the pliability and resilience of the body surface paint to flex sufficiently to allow the dent to return substantially to its original shape without blistering or peeling. This approach enables the repair shop to correct dents without the need for cutting, replacing and refinishing or puttying and refinishing body panels. The cost savings of PDR over such aggressive procedures is considerable.

More specifically, for PDR, it is common practice to utilize specially designed hand tools to reach into vehicle body compartments to push out or relieve a body dent from the inside outward. These PDR tools are traditionally configured with a metal handle or grip from which extends a metal rod or stem with a short tip opposite the handle that extends angularly away from the stem. The stem segment may be linear from handle to tip, or in some instances may have one or more relatively acute bends between handle and grip. The tip and stem segments of the tool are thread through inner access ports in the vehicle body such that the tip can reach and press against the inner surface of a dent to thereby enable the tool to exert pressure from the inside of the body to remove the dent.

Unfortunately, while traditional PDR tools are offered in a wide variety of lengths and a variety of various combinations of one or more sharp or acute bends along the length of the stem segments, they nonetheless have significant shortcomings. First, because the stem segments are comprised of one or more straight lengths, traditional PDR tools in practice have difficulty in reaching deep into side channels or other such body compartment areas to reach dents that could otherwise be removed by PDR, and in particular in vehicle hoods and trunk lids. Further, such traditional configurations suffer in the limited amount of torque that can be applied through the tool to the dent. In addition, due to their shapes and configurations, traditional PDR tools often impart damage to the body access ports through which they are positioned during the dent removal operation as the user twists and turns the tool in and against the access port for leverage to exert force at the tip end of the tool.

It would therefore be desirable to have a simple PDR hand tool that could repair hard-to-reach dents in areas of a vehicle body that traditional PDR tools cannot access or have difficulty accessing, with the ability to apply more torque to dents during the dent removal process. It would also be desirable to have a simple PDR hand tool that could repair vehicle body dents while reaching the dents through body access ports without causing damage to the ports. As will become evident in this disclosure, the present invention provides such benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
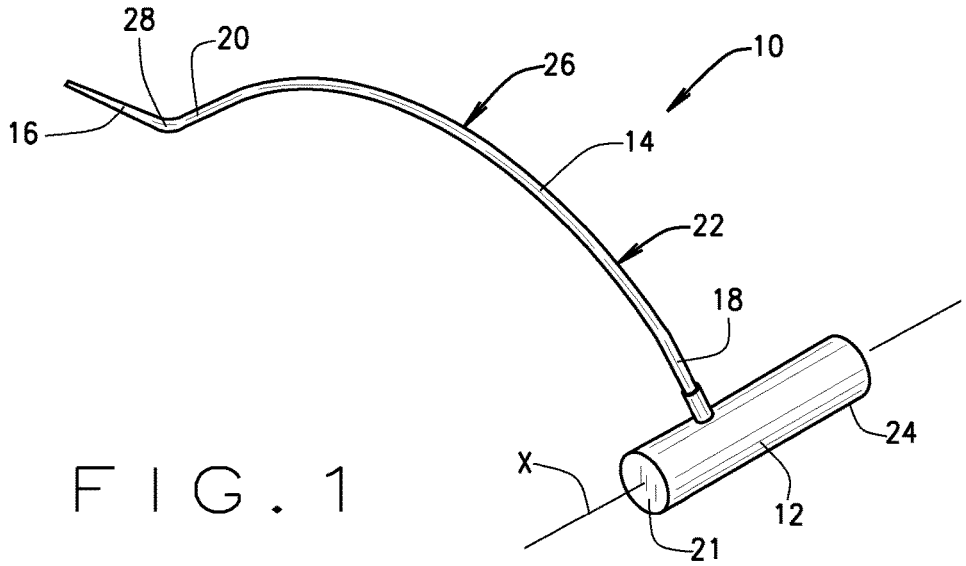
FIG. 1 is a perspective view of a representative embodiment of a PDR hand tool of the present invention.
Figure 2:
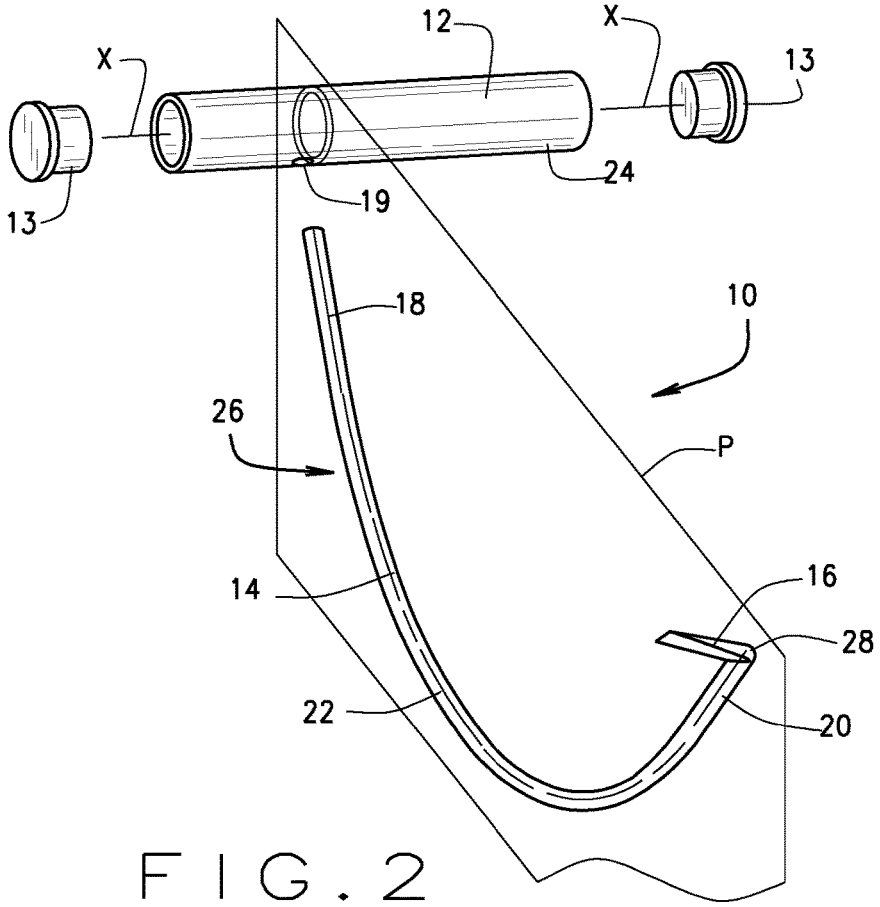
FIG. 2 is an exploded view of the PDR hand tool of FIG. 1.
Figure 3:
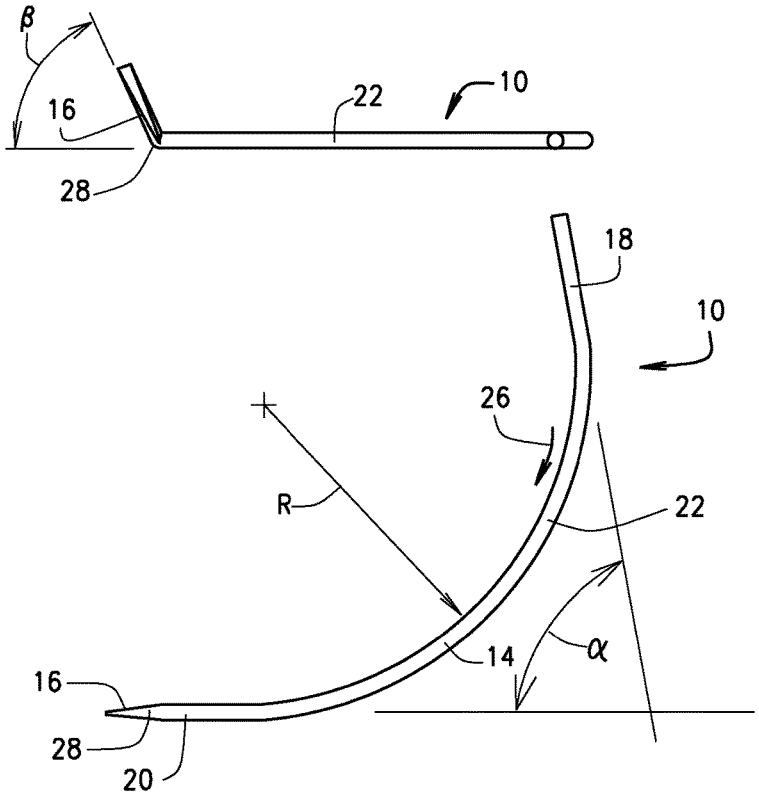
FIG. 3 is a plan view and corresponding top view of the stem and tip of the PDR hand tool of FIG. 1.
Figure 4:
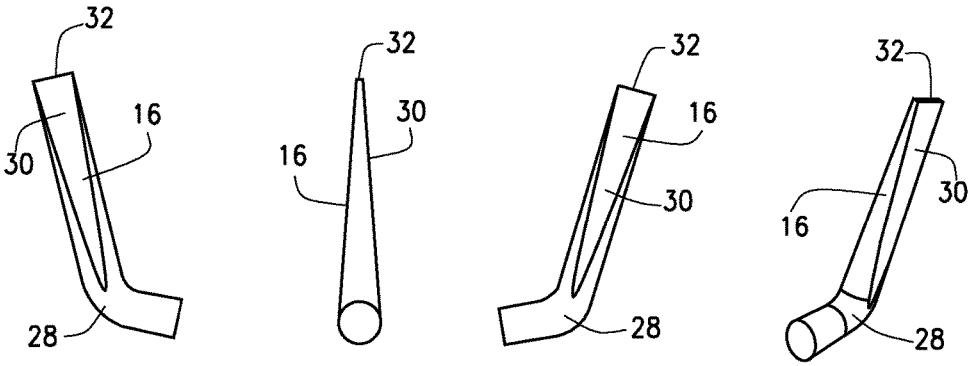
FIG. 4 is a perspective view and corresponding top and plan views for a tip and portion of a stem of the PDR hand tool of FIG. 1.

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

In referring to the drawings, a first representative embodiment of the novel paintless dent removal ("PDR") tool 10 of the present invention is shown generally in FIGS. 1-4, where the present invention is depicted by way of example. In this first representative embodiment, the PDR tool 10 comprises a hollow metal handle 12, a rigid metal stem 14, and a tip 16. The handle 12 is formed of a generally cylindrical length of metal tubing approximately one inch in diameter and approximately five inches long with a central axis X, such that the handle 12 fits readily in the palm of the user's hand to be gripped by the user's fingers. The ends of the handle 12 are parallel to one another perpendicular to the central axis X of the handle 12. Plugs 13 are press-fit snugly into each end of the handle 12. The stem 14 has a straight proximal segment 18 of approximately three inches length that attaches to the handle 12 and a straight distal segment 20 of approximately 2 inches in length from which extends the tip 16 opposite the proximal segment 18, with a midsection 22 there between.

The stem 14 is rigidly secured at its proximal segment 18 within a bore 19 in the side of the handle 12 located approximately one third the distance from one end of the handle 12, such that approximately two inches of the proximal segment 18 extends perpendicularly from the bore 19 in the side of the handle 12. A thick, pliant plastic tool coat 24 encases the handle 12 and a small portion of the proximal segment 18 of the stem 14 that extends from the bore 19 in the side of the handle 12.

In this first representative embodiment, the stem 14 has a circular cross section (see A at FIG. 9) with a diameter of approximately one quarter inch, and forms an elongated curve having a substantially rigid continuously radiused shallow or sweeping arc 26 across the full length of midsection 22.

It should be noted that the elongated curves of this disclosure, such as the sweeping arc 26, along the length of a shaft or rod, such as the stem 14, are readily distinguished over tight bends or sharp angles in a shaft or rod. That is, a tight bend or sharp angle changes the direction of the shaft or rod over a compressed length of the shaft or rod, while an elongated curve shifts the direction of the shaft or rod over an extended or elongated length of the shaft or rod. This distinction is true even when the tight bend or sharp angle is formed by a very tight or sharp curve. The elongated curves of this disclosure, such as for example the arc 26, contemplate this very distinction.

Referring again to FIGS. 1-4, the arc 26 defines a plane P that is perpendicular to the central axis X of the handle 12 and bisects the handle 12 at the bore 19. The plane P also encompasses the proximal segment 18 and the distal segment 20. Further, in this embodiment, the midsection 22 of the stem 14 has an overall length of approximately 13 inches and the arc 26 formed in the midsection 22 of the stem 14 has a radius of curvature R of approximately 7.25 inches. The bend angle $\alpha$ for this embodiment, that is, the total angle of curvature between the proximal segment 18 and the distal segment 20, is approximately 79 degrees.

The tip 16 (FIG. 4) extends from the distal segment 20 of the stem 14 at a sharp bend 28 having an angle $\beta$ of approximately 65 degrees away from the plane P defined by the arc 26, and has a has an elongated dual-sided 4 degree taper 30 along its full length that ends in a square edge 32 of approximately 0.04 inches by 0.25 inches that is generally perpendicular to the length of the tip 16.

Of course, these dimensions can vary across a set of ranges. That is, the length of the midsection 22 can range from a few inches to several feet, the proximal and distal segments 18 and 20 can each range in length from zero inches to a foot or more, the tip 16 can have a length of less than an inch to several inches, the angle $\alpha$ can range from just over zero to nearly 180 degrees, and the radius of curvature R can range from under an inch to over a foot. Moreover, where the elongated curve of the midsection 22 varies in curvature along its length, R constitutes an overall average radius of curvature for the incremental radii of curvature along the length of the midsection 22. Some variations in the embodiments of the present invention are shown by way of example in FIGS. 5-8.

However, it has been discovered by the inventor that there is a preferential range for each of these dimensions, outside of which the benefits of the invention are marginalized. In particular, the overall length of the stem 14 should be no shorter than approximately six inches, because using a PDR tool of the present invention having a stem 14 shorter than six inches provides little or no advantage over traditional PDR tools with a straight stems or stems with one or more sharp bends due to vehicle body geometries in interior contours that extend less than six inches from an access port. In addition, the overall length of the stem 14 will need be no longer than approximately twenty-four inches, because there are few applications in which the tool 10 will need to extend further into the vehicle body. Likewise, the midsection 22 should preferably range from approximately six to twenty-four inches. Further, a radius of curvature R of less than two inches (2") will substantially result in too a tight bend in the midsection 22, while a radius of curvature greater than twelve inches (18") will result in an overly straight midsection 22, either of which will not provide any significant improvement over traditional PDR tool and will deprive the PDR tool of the benefits of the present disclosure.

Figure 5:
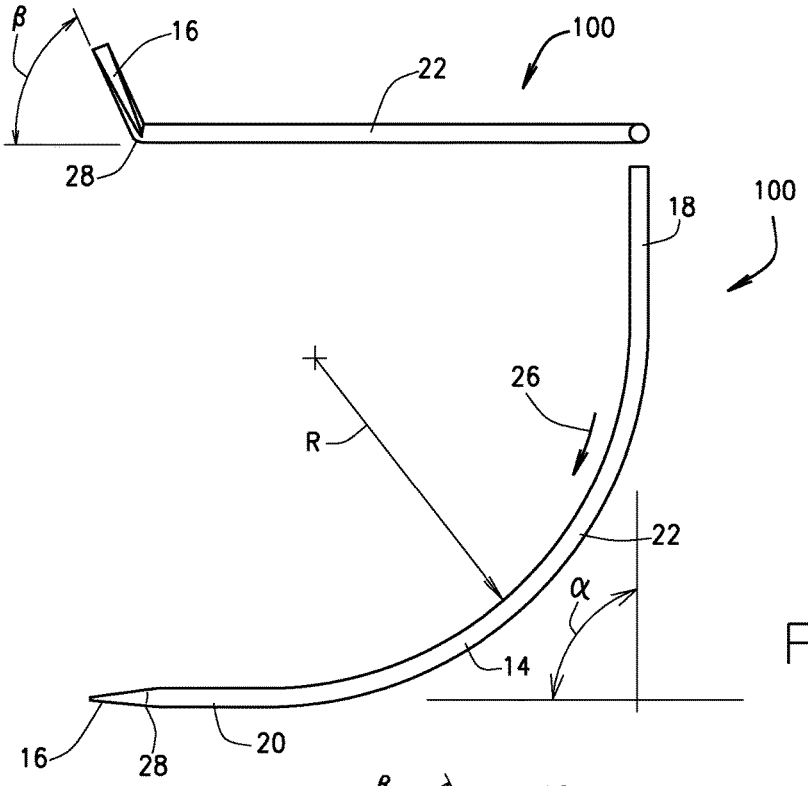
FIG. 5 is a plan view and corresponding top view for a stem and tip of a second representative embodiment of a PDR hand tool of the present invention.
Figure 6:
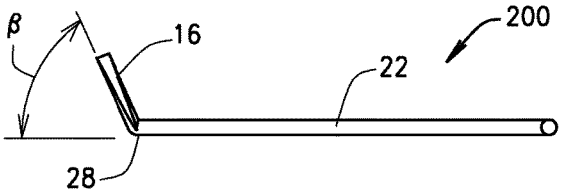
FIG. 6 is a plan view and corresponding top view for a stem and tip of a third representative embodiment of a PDR hand tool of the present invention.
Figure 6:
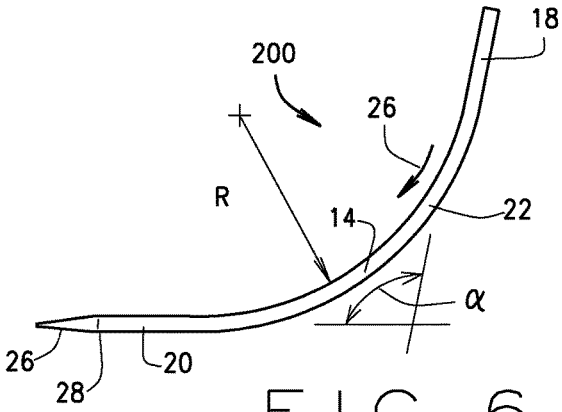

By way of further example, a second representative embodiment of the novel PDR tool of the present invention is shown generally at 100 in FIG. 5 and a third representative embodiment is shown generally at 200 in FIG. 6. In these second and third embodiments, the PDR tool is configured generally the same as the PDR tool 10, but have differing dimensions. That is, the PDR tools 100 and 200 both comprise a hollow metal handle 12, a rigid metal stem 14, and a tip 16. The handle 12 is formed of a generally cylindrical length of metal tubing approximately one inch in diameter and approximately five inches long with a central axis X, such that the handle 12 fits readily in the palm of the user's hand to be gripped by the user's fingers. The ends of the handle 12 are parallel to one another perpendicular to the central axis X of the handle 12. Plugs 13 are press-fit snugly into each end of the handle 12. The stem 14 has a straight proximal segment 18 of approximately three inches length that attaches to the handle 12 and a straight distal segment 20 of approximately 2 inches in length from which extends the tip 16 opposite the proximal segment 18, with a midsection 22 there between.

As in the first representative embodiment of the PDR tool 10, the stem 14 is rigidly secured at its proximal segment 18 within a bore 19 in the side of the handle 12 located approximately one third the distance from one end of the handle 12, such that approximately two inches of the proximal segment 18 extends perpendicularly from the bore 19 in the side of the handle 12. A thick, pliant plastic tool coat 24 encases the handle 12 and a small portion of the proximal segment 18 of the stem 14 that extends from the bore 19 in the side of the handle 12.

The stem 14 has a circular cross section (see A at FIG. 9) with a diameter of approximately one quarter inch, and forms an elongated curve having a substantially rigid continuously radiused shallow or sweeping arc 26 across the full length of midsection 22. The arc 26 defines a plane P that is perpendicular to the central axis X of the handle 12 and bisects the handle 12 at the bore 19. The tip 16 (FIG. 4) extends from the distal segment 20 of the stem 14 at a sharp bend 28 having an angle α of approximately 65 degrees away from the plane P defined by the arc 26, and has a has an elongated dual-sided 4 degree taper 30 along its full length that ends in a square edge 32 of approximately 0.045 inches by 0.241 inches that is generally perpendicular to the length of the tip 16.

However, in the second embodiment at 100 (FIG. 5), the midsection 22 of the stem 14 has an overall length of approximately 8.5 inches, the arc 26 formed in the midsection 22 of the stem 14 has a radius of curvature R of approximately 5.38 inches, and the bend angle α is approximately 90 degrees. In the third embodiment at 200 (FIG. 6), the midsection 22 of the stem 14 has an overall length of approximately 5.5 inches, the arc 26 formed in the midsection 22 of the stem 14 has a radius of curvature R approximately 3.75 inches, and the bend angle α is approximately 102 degrees.

Figure 7:
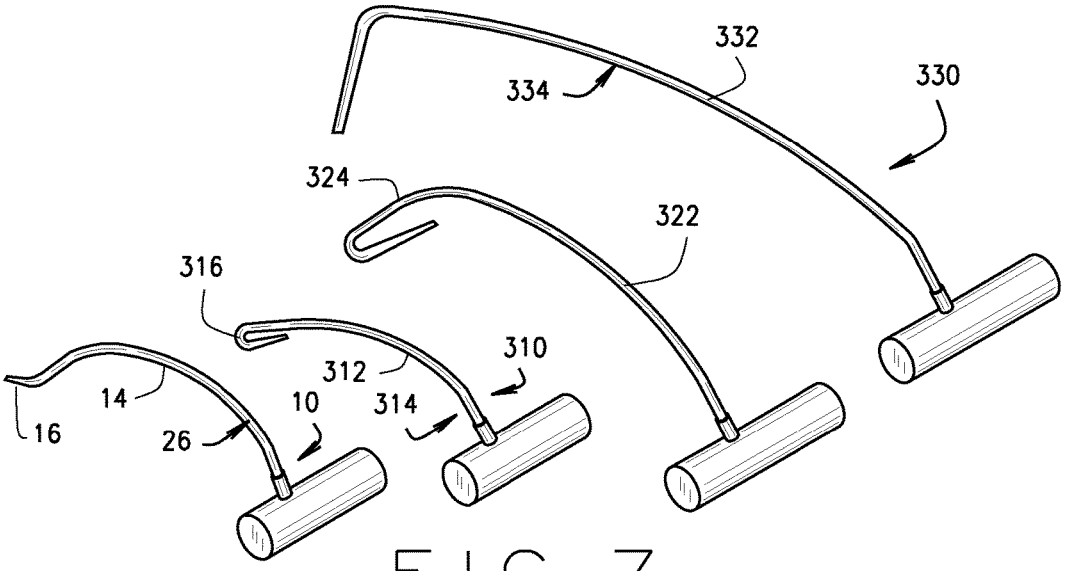
FIG. 7 is a perspective view of three alternate tip configurations for the PDR hand tool of FIG. 1.
Figure 8:
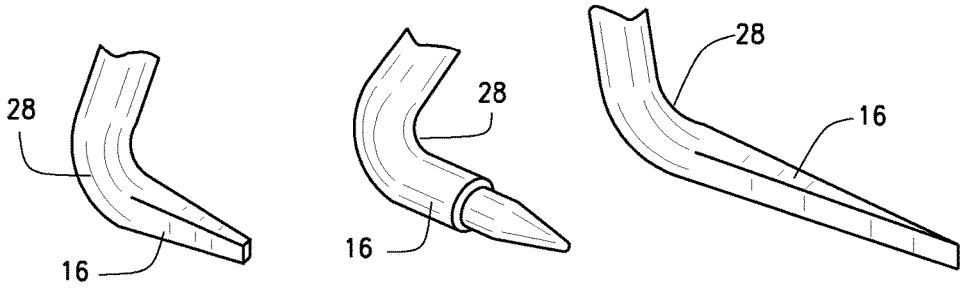
FIG. 8 is a perspective view of a set of four PDR hand tools with differing tip configurations and stem portion configurations, each tool encompassing a representative embodiment of a PDR hand tool of the present invention.

It is further contemplated that sets of PDR tools 10 can be produced with varying dimensions and configurations to facilitate flexibility in the dent removal process. A representative example would be to produce a set comprising the PDR tools 10, 100 and 200. As another representative example, FIG. 7 shows a set of four various PDR tools 10, 310, 320, 330 and 340 with differing configurations and dimensions. That is, the PDR tool 10 has the configuration and dimensions discussed hereinabove, while the PDR tool 310 has a stem 312 with an arc 314 having a radius greater than that for the arc 26 of the PDR tool 10, and a sharply-curved tip 316 in contrast to the straight tip 16. Similarly, the PDR tool 320 has a stem 322 that is longer than both the stem 14 of the PDR tool 10 and the stem 312 of the PDR tool 310, and comprises a medium-curved tip 324 that contrasts the straight tip 16 of the PDR tool 10 and the tightly curved tip 314 of the PDR tool 310. In the same vein, the PDR tool 330 comprises an even longer stem 332 than each of the PDR tools 10, 310 and 320, along with an arc 334 having an even greater radius of curvature than each of the PDR tools 10, 310 and 320. Further, the PDR tool 10 can also have a variety of configurations for the tip 16. Representative examples are shown in FIG. 8.

Figure 10:
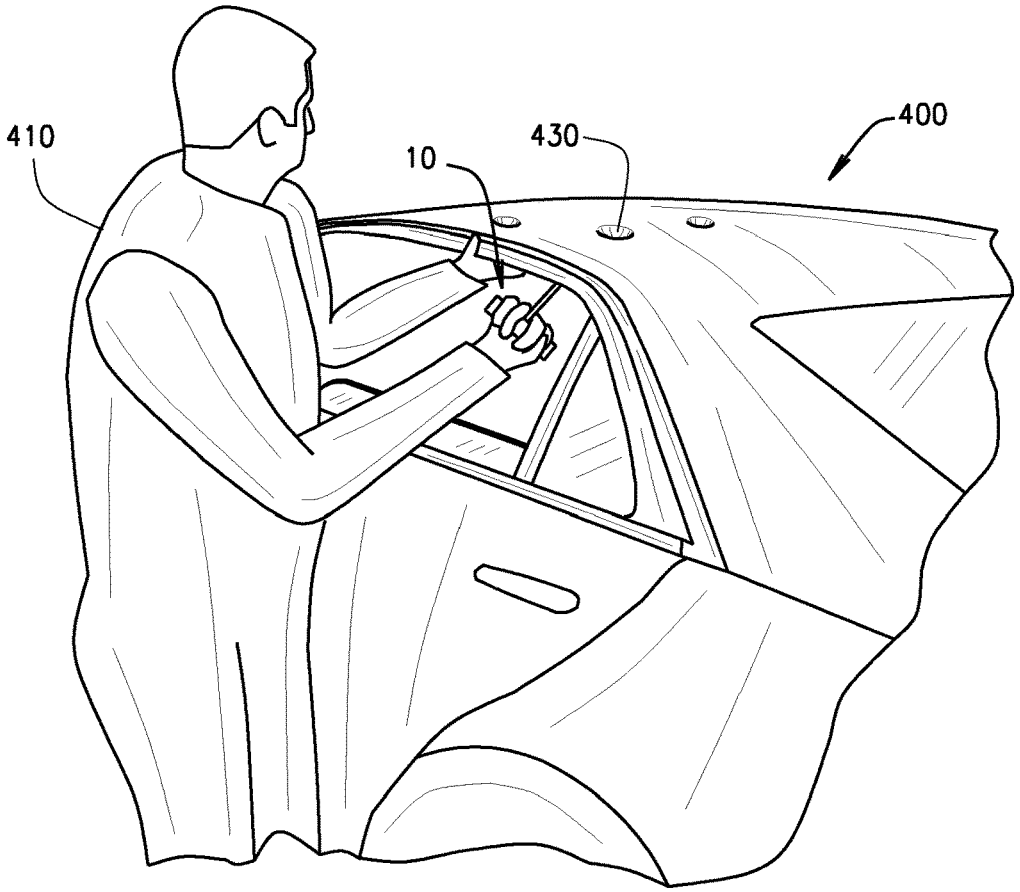
FIG. 10 is a perspective view of an individual using the PDR hand tool of FIG. 1 to remove a dent from the top of a vehicle as part of a PDR operation.
Figure 11:
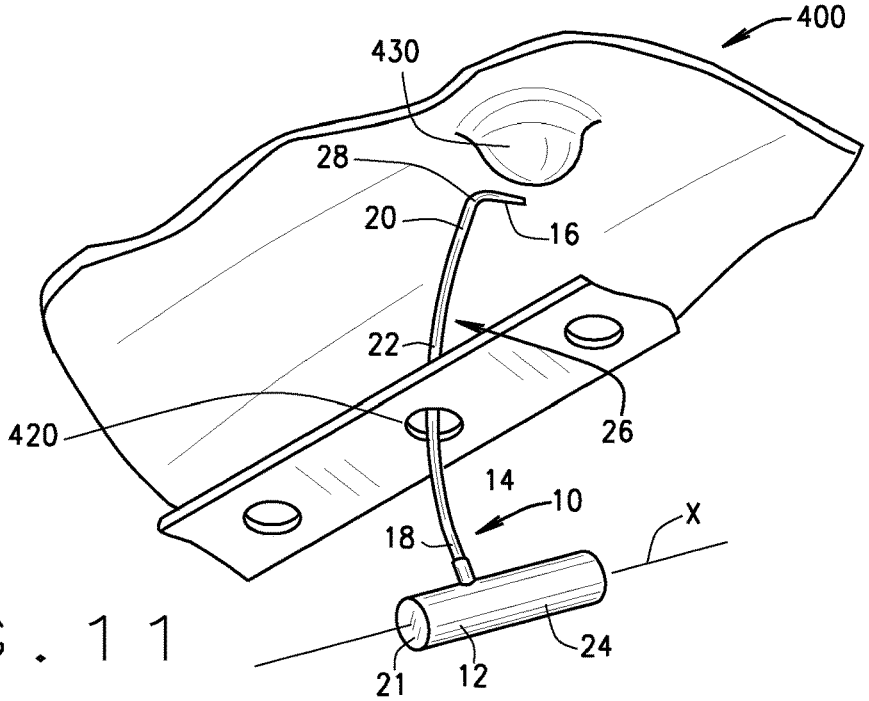
FIG. 11 is a perspective cutaway view of the PDR hand tool of FIG. 1 with the tip and stem portion positioned through a vehicle body access port and into a body cavity of the vehicle, the body of the cavity having a dent to be repaired.

As shown by way of example in FIGS. 10 and 11, in operation to remove dents from a vehicle such as for example at 400, the PDR tool 10 allows a user 410 to firmly grasp the handle 12 of the PDR tool 10 with a single hand by wrapping the user's fingers about the handle 12 such that the stem 14 project from between two of the user's fingers. The stem 14 can then be controllably inserted by the user 410 into access openings or ports into or under the body of the vehicle 400, such as for example the opening 420. The user 410 then directs the stem 14 through the opening 420 until the tip 16 is positioned in proximity to a dent in the body of the vehicle 400 that the user desires to remove, such as at 430. This results in the tip 16 being positioned inside the body of the vehicle 400 for dent removal, while at the same time the handle 12 remains readily accessible outside the body.

The user 410 can then grasp the handle 12 to readily manipulate the PDR tool 10 from the exterior of the vehicle 400. By turning, twisting, pushing and pulling the handle 12, the user can press, push or otherwise massage the inner surface of the dent 430 with the tip 16 to straighten the dent 430 from the inside of the body of the vehicle 400. However, the novel PRD tool 10 of the present invention is configured to allow the user to "rock" and "pull" the handle 12 of the tool 10 and thereby impart substantial torque through the elongated curve 26 of the midsection 22 to the tip 16 and against the dent 430.

Figure 12:
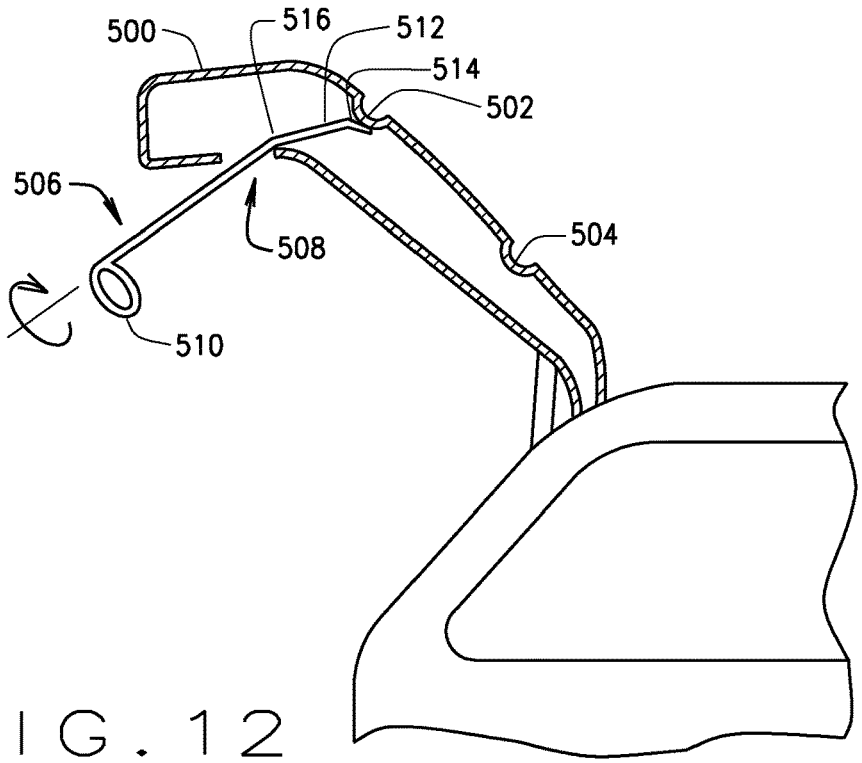
FIG. 12 is a side view of a dented vehicle trunk lid being repaired with a traditional PDR hand tool, with the tip and stem portion of the tool positioned through the vehicle's trunk lid body access port and into the trunk lid of the vehicle.
Figure 13:
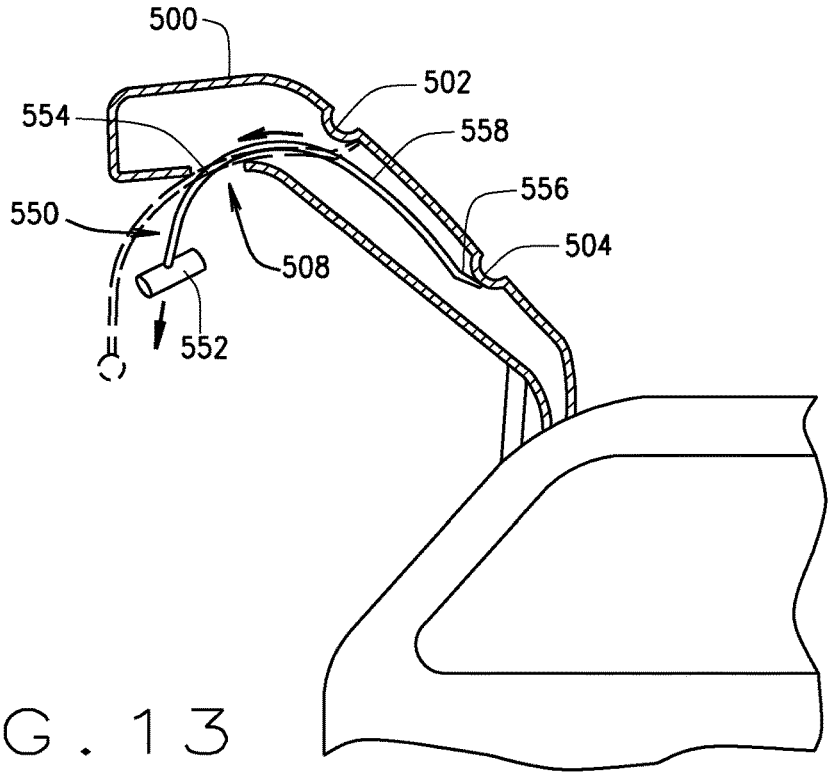
FIG. 13 is a side view of a dented vehicle trunk lid being repaired with the PDR hand tool of FIG. 1 in two positions, with the tip and stem portion of the tool positioned through the vehicle's trunk lid body access port and into the trunk lid of the vehicle with the first position repairing a first dent and the second position repairing a second dent.

An example of benefits provided by the present invention over traditional straight or bent PDR tools can be seen in a comparison of FIGS. 12 and 13. FIG. 12 shows a vehicle trunk lid 500 that has a pair of dents 502 and 504 on the top outer surface of the lid 500. A traditional "bent" PDR tool 506 is shown inserted through an access opening 508 located on the lower outer surface of the trunk lid 500. The tool 506 has a handle 510, a stem 512, a tip 514 opposite the handle 510 extending at an angle away from the stem 512, and a sharp bend 516 in the stem 512 between the handle 510 and the tip 514.

As can be seen, the traditional tool 506 is able to just reach the dent 502. With the tip 514 braced against the dent 502 and the bend 516 between the tip 514 and the stem 512 braced against the trunk lid surface opposite the dent 502, the handle 510 is "twisted" to force the tip 514 against the dent 502 to push out the dent 502 from the inside. In order to generate additional force to repair the dent 502, the user will often force to the handle 510 of the traditional tool 506 in a direction counter to that of the tool's tip 514 pressing against the dent 502. In order to do so, the user must push or press the stem 512 of the traditional tool 506 against the edges of the access opening 508.

In contrast, in FIG. 13, a PDR tool 550 of the present invention is shown inserted through the access opening 508. The tool 550 has a handle 552, a stem 554, a tip 556 opposite the handle 552 extending at an angle away from the stem 554, and an elongated curve 558 in the stem 554 extending from the handle 552 to the tip 556. As can be seen, the PDR tool 550 is also able to reach the dent 502 as the traditional tool 506 in FIG. 12. However, due to the novel incorporation of the elongated curve 558 along the stem 554 of the tool 550, the user can apply a "rolling" and "pulling" motion to the handle 552 to force the tip 556 against the dent 502 and thereby impart substantial torque generated in those motions through the elongated curve 558 and to the tip 556 to push out the dent 502. In practice, because it lacks an elongated curve, a traditional straight or "bent" tool, such as for example the tool 506, does not lend itself to manipulation with a "rolling" and "pulling" motion. Further, the ability of the tool 550 to impart substantial torque with this "rolling" and "pulling" motion reduces the need and temptation to force the stem 554 against the edges of the opening 508 in order to manipulate the tip 556 to remove the dent 502, as is often done with traditional straight or "bent" tools, such as for example the tool 506.

In addition, when reaching into areas around corners or bends in the vehicle body, the "bent" traditional PDR tool must be used, if a traditional PDR tool is to be used at all. However, because PDR tools must be long and relatively small in cross-section, traditional "straight" or "bent" PDR tools have a limited reach before they lose effectiveness. As shown in FIG. 12, the traditional "bent" tool 506 is unable to reach the dent 504—a common problem in the industry. While it may seem that simply extending the tool would solve this problem, this does not work. That is because, as the inventor has discovered, elongating a "bent" tool will limit the amount of force that can be applied from the tool's handle to the tip as the "bend" in the tool will flex to such an extent as to absorb a large amount of that force. This results in a limited range or practical length for the traditional tool, such as the tool 506. The incorporation of an elongated curve along the stem as claimed by the inventor, alleviates this problem in two ways. First, as already described, the shape of the tool 550 of the present invention (such as for example the tool 550) allows the tool, such as 550 of the present invention, to be "rolled" and "pulled" from the handle to repair vehicle body dents. This enables the user to apply radial forces to the dent while applying a minimum amount of force along any particular portion of the length of the stem, such as at 554. In addition, to the extent the tool, such as 550 of the present invention, is used to apply "rocking" forces to the dent, such forces are distributed along the entire elongated curve 558 of the tool 550, and not concentrated at a single point, such as a "bend" in a traditional PDR tool, such as for example the bend 516 of the tool 506.

While I have described in the detailed description several configurations that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel mechanisms of the present invention, shown by way of example at 10 can be arranged in a number of other and related varieties of configurations without departing from or expanding beyond the scope of my invention as set forth in the claims.

For example, the elongated curve of the midsection 22 of the stem 14 can occupy more than one plane. That is, the midsection 22 can change the course of the stem 14 in the direction of the arc 26, and in addition, change the direction of the stem in one or more other directions. Similarly, the stem 14 is limited to a single elongated curve, such as the arc 26, but can comprise a plurality of arcs of varying sizes and dimensions, so long as at least one of such arcs comprises an elongated curve. Likewise, the stem 14 of the PRD tool 10 can incorporate tight bends or sharp angles, so long as the stem 14 of the PDR tool 10 comprises at least one elongated curve, such as the arc 26.

Also, while preferable, it is not necessary that the stem 14 extend in a perpendicular fashion from the handle 12 or that the stem 14 extend from the stem 14 at the specific position disclosed in the Figures. Rather, the stem 14 may extend from the handle 12 in any variety of directions and from any variety of positions on the handle 12 so long as such configurations still enable the PDR tool 10 to provide the benefits and function in the PDR process as discussed herein.

By way of further example, the handle 12 can be configured in a wide variety of shapes and sizes, so long as the handle 12 can be readily gripped by the user's hand or hands and provides adequate structural integrity for the stem 14 to perform the PDR procedures as disclosed herein. Hence, the handle 12 may be constructed in the shape of a grip molded to conform to the user's hand. The handle 12 may alternately have a square, rectangular or oval cross section.

Figure 9:
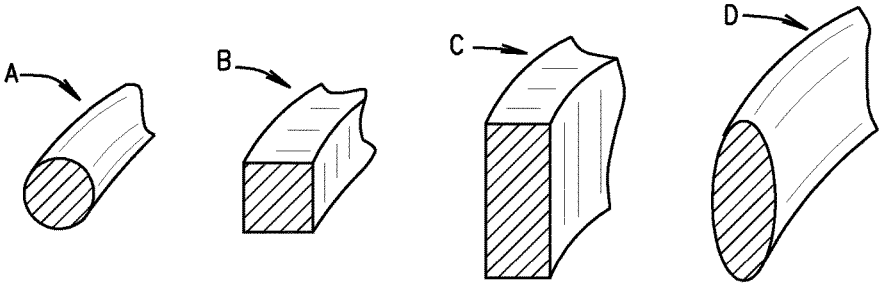
FIG. 9 is perspective sectional view of four alternate cross-section configurations for the stem portion of the PDR hand tool of FIG. 1.

As depicted in FIG. 9, the stem 14, and by extension the tip 16, may be configured of various cross-sectional shapes, such as for example, circular (see FIG. 9A), square (see FIG. 9B), rectangular (see FIG. 9C) or oval (see FIG. 9D). Likewise, the tip 16 may be produced in a wide variety of shapes and configurations, such as for example, a blunt dual-taper blade resembling a standard screwdriver head (see FIG. 8A), a cone (see FIG. 8B), or an elongated dual-taper blade (see FIG. 8C).

Additional variations or modifications to the configuration of the novel mechanism of the present invention, shown by way of example at 10, may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention. Accordingly, all matter contained in the above description or shown in the accompanying drawings should be interpreted as illustrative and not in a limiting sense.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

The invention claimed is:

1. A paintless dent removal tool comprising:

a. a handle, said handle having a first end and a second end opposite the first end, said handle having an elongated gripping surface extending between said first end and said second end, said gripping surface being sized and shaped for a human to grasp with a hand;

b. a substantially rigid stem, said stem having a proximal end and a distal end opposite the proximal end, the proximal end extending from the gripping surface of the handle, the stem defining an elongated curve between the proximal end and the distal end of the stem, said elongated curve having a first end proximal the handle and a second end opposite the first end, said elongated curve having a length of between six inches and twenty-four inches, said elongated curve having an average radius of curvature along said length of between two inches and twelve inches; and c. a substantially rigid elongated tip extending generally at an angle B away from the distal end of the stem, the tip having a length that is less than one half the overall length of the elongated curve.

2. The tool of claim 1, wherein the elongated curve defines a first plane, and the tip extends at least in part out of said first plane.

3. The tool of claim 2, wherein the elongated curve rests substantially fully in said first plane.

4. The tool of claim 1, wherein the elongated curve is positioned along the stem at least in part approximately three inches or less from the gripping surface of the handle.

5. The tool of claim 1, wherein the stem further comprises one of a substantially straight proximal segment positioned between the proximal end of the stem and the elongated curve or a substantially straight distal segment positioned between the distal end of the stem and the elongated curve.

6. The tool of claim 5, wherein one of said proximal segment or said distal segment of the stem has a length of under three inches.

7. The tool of claim 1, wherein the elongated curve has a length that is greater than one half the overall length of the stem.

8. The tool of claim 1, wherein the elongated curve has a length that is greater than three fourths the overall length of the stem.

9. The tool of claim 1, wherein the elongated curve has a length that is substantially the same as the overall length of stem.

10. The tool of claim 1, wherein the elongated curve has a length of between five inches and fourteen inches.

11. The tool of claim 10, wherein the elongated curve has an average radius of curvature along its length of between three inches and six inches.

12. The tool of claim 1, wherein the radius of curvature of the elongated curve is constant along at least a portion of the length of the elongated curve.

13. The tool of claim 12, wherein the radius of curvature of the elongated curve is constant along the entire length of the elongated curve.

14. The tool of claim 1, wherein the elongated gripping surface of the handle has a longitudinal midpoint, and the proximal end of the stem extends in a generally perpendicular direction from the gripping surface of the handle at a point longitudinally offset from said midpoint.

15. The tool of claim 1, wherein the proximal end of the stem extends in a generally perpendicular direction from the gripping surface of the handle at a point approximately one third the distance from the first end to the second end of the handle.

16. The tool of claim 5, wherein the stem comprises a substantially straight proximal segment positioned between the proximal end of the stem and the elongated curve and a substantially straight distal segment positioned between the distal end of the stem and the elongated curve, said proximal segment and said distal segment being substantially coplanar and defining a bend angle therebetween.

17. The tool of claim 16, wherein the bend angle measures between approximately 60 degrees and approximately 120 degrees.

18. The tool of claim 17, wherein the bend angle measures between approximately 90 degrees and approximately 110 degrees.

19. A paintless dent removal tool for use on a vehicle having a body, said tool comprising:

a. a handle having an elongated gripping surface with a longitudinal midpoint, a first end and a second end opposite the first end, said elongated gripping surface being positioned between said first and second ends and being sized and shaped at least in part for a human to grasp with a hand;

b. a substantially rigid stem, the stem having a proximal end and a distal end opposite the proximal end, said proximal end of the stem extending in a substantially perpendicular manner from the elongated gripping surface of the handle at a point longitudinally offset from the midpoint of the elongated gripping surface, the stem defining an elongated curve between the proximal end and the distal end of the stem, said elongated curve having a length between six and twenty-four inches; and c. a substantially rigid tip having a length that is less than one half the overall length of the elongated curve, said tip extending in a generally angular fashion from the distal end of the stem.

20. The tool of claim 19, wherein said elongated curve has an average radius of curvature along said length of between two inches and twelve inches.

21. The tool of claim 19, wherein the stem comprises a substantially straight proximal segment positioned between the proximal end of the stem and the elongated curve and a substantially straight distal segment positioned between the distal end of the stem and the elongated curve, said proximal segment and said distal segment being substantially coplanar and defining a bend angle therebetween, said bend angle measuring between approximately 60 degrees and approximately 120 degrees.

22. The tool of claim 19, wherein the length of the elongated curve is greater than one half the overall length of the stem.

23. The tool of claim 22, wherein the length of the elongated curve is greater than three fourths the overall length of the stem.

* * * * *